United States Patent [19]

Juang

[11] Patent Number: 4,599,071

[45] Date of Patent: Jul. 8, 1986

[54] ADJUSTABLE BEACH-SHOES

[76] Inventor: Ruey T. Juang, No. 26, Pi-Feng Rd., Tsaotun, Nantu Hsien, Taiwan

[21] Appl. No.: 673,035

[22] Filed: Nov. 19, 1984

[51] Int. Cl.[4] ..... A63C 31/10

[52] U.S. Cl. ..... 441/64; 441/61; 441/62; 441/63

[58] Field of Search ..... 441/55, 60–64

[56] References Cited

U.S. PATENT DOCUMENTS

| | | | |
|---|---|---|---|
| 1,688,498 | 10/1928 | Jacobsen | 441/62 |
| 2,980,926 | 4/1961 | Wolshin | 441/64 |
| 3,068,499 | 12/1962 | Biskupsky | 441/63 |
| 3,178,738 | 4/1965 | Trell | 441/64 |
| 4,178,128 | 12/1979 | Gongiver | 441/62 |

*Primary Examiner*—Trygve M. Blix
*Assistant Examiner*—C. T. Bartz

[57] ABSTRACT

The improvement provided by this invention is directed at the conventional beach-shoe and diving flipper, and according to this invention, a novel beach-shoe capable of acting as a diving flipper is provided. The web portion is extensible relative to a shoe body, the shoe can be used as a beach-shoe when a web member is received in a recess of the shoe body, and a guarding piece is placed in a cut-out made in the front end of the shoe body to admit the web member to pass through. The shoe body comprises a platform including peripheral walls, the opposite side portions of the peripheral walls are formed with inside guiding grooves, the front portion and rear portion are respectively formed with a cut-out, the two cut-outs have identical shape which corresponds to the shape of a guard piece, so that a guard piece can be placed in alternative cut-out, when placed in the cut-out of the front portion, the web member can be restricted in the recess, and it should be removed therefrom to place in the cut-out of the rear portion when the web member is desired to be pulled into a stretched position.

2 Claims, 5 Drawing Figures

ADJUSTABLE BEACH-SHOES

BACKGROUND OF THE INVENTION

This invention is related to an adjustable beach-shoe which can be converted into a diving flipper through an adjustment, which comprises a collapsible web which can be received in a recess formed in the shoe to act as a beach-shoe, or can extend out of the recess for acting as a diving flipper.

In the summer, most people like to occupy themselves at the beach with various activities, and each activity often requires special equipment. For example, one needs beach shoes for strolling and diving flippers for swimming, however, carrying both is very inconvenient, so that the inventor is motivated to contrive the present invention.

The sand on the beach usually becomes very hot after the sun shines for a period of time and may burn one's bare feet when one walks on it without protection for his feet. Beach-shoes are necessary in such a situation. However, when one takes underwater activities, he is not in need of the beach-shoes for that time, so that keeping track of his beach-shoes sometimes becomes a problem. If the beach-shoes are placed on the shore, the tidewater may wash them away, or someone may steal them. Furthermore, even if they don't become lost, when they are left on the shore for a period of time, they may become uncomfortably hot from the sun, or possibly become damaged. In view of the above facts, the conventional beach-shoes are not satisfactory.

The diving flipper has been used for a long time as a useful aid to underwater swimming, however, while walking on the land, the diving flipper must be removed, therefore, similar problems like those of the beach-shoes may also be encountered.

SUMMARY OF THE INVENTION

With the above drawbacks existing with the beach-shoe and diving flipper in view, it is a general object of this invention to provide a beach-shoe which can be converted into a diving flipper.

It is another object of this invention to provide a beach-shoe which can be worn under water through a simple adjustment to pull out the web.

Referring to the drawings, in which.

Figure 1:
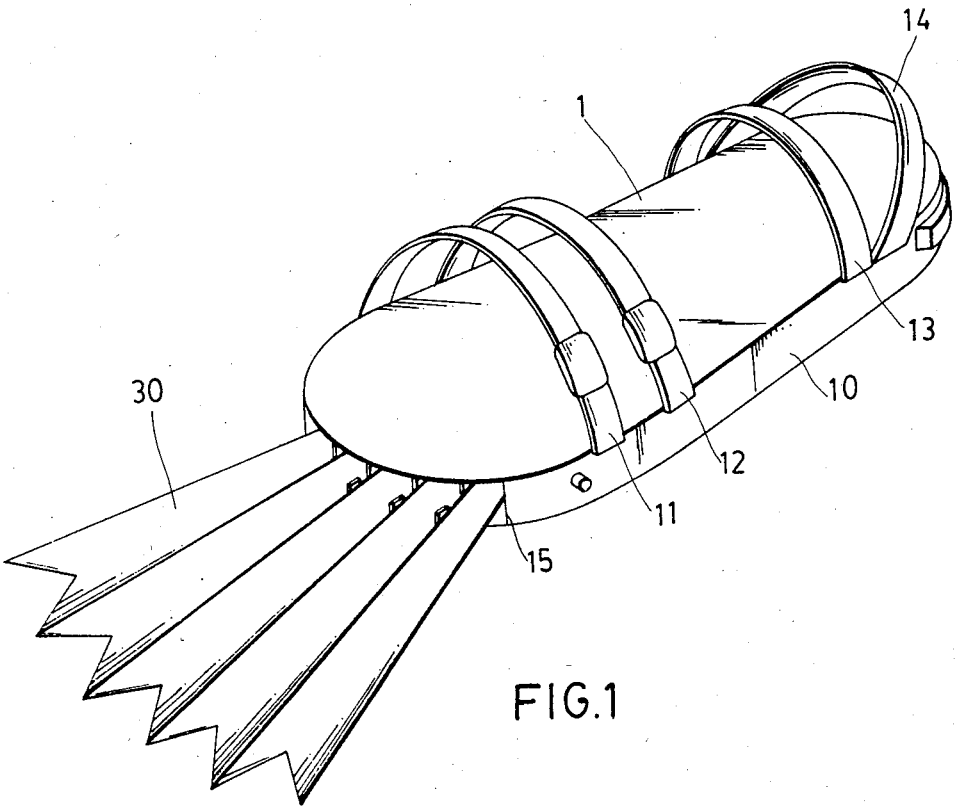
FIG. 1 is a perspective view of the adjustable beach-shoe according to this invention.

Referring now to FIG. 1, a preferred embodiment of the shoes comprises a platform 10 and four flexible straps 11, 12, 13, 14, two of them are secured on the front section of the platform 10, and the other two are secured on the rear section of the platform 10. These four flexible straps 11, 12, 13, 14 are adjustable in length to adapt to the user's foot.

The peripheral walls of the platform 10 are formed with a first cut-out 15 on the front end for admitting a web 30 to pass through, so that when the web 30 is pulled out and held between the sole 40 and the the platform 10 at the front end of the platform 10, the shoes can be used as a diving flipper as shown in FIG. 1, and, where the web 30 is pushed into a recess 16 (not seen in FIG. 1) and held therein, then the shoes can be used as a beach-shoe to prevent the feet from burning by the hot sand.

Figure 2:
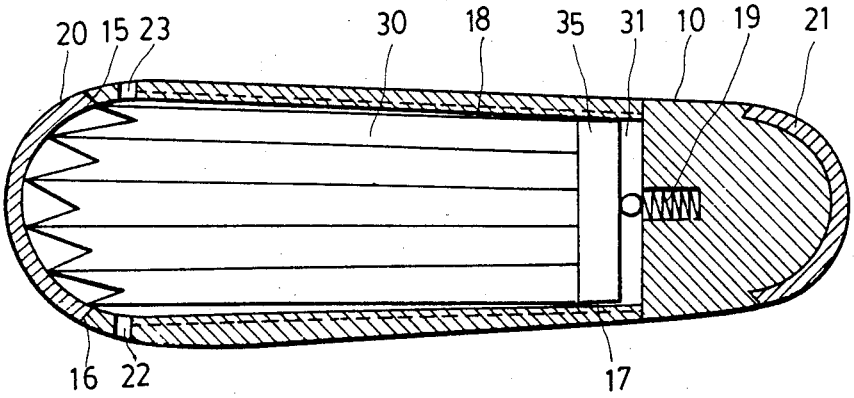
FIG. 2 is a horizontal section view of the beach-shoe shown in FIG. 1, with the web shown in a collapsed position.
Figure 3:
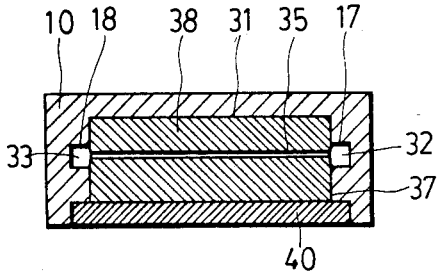
FIG. 3 is a transverse section view of the beach-shoe shown in FIG. 1, with the web shown in a collapsed position.
Figure 4:
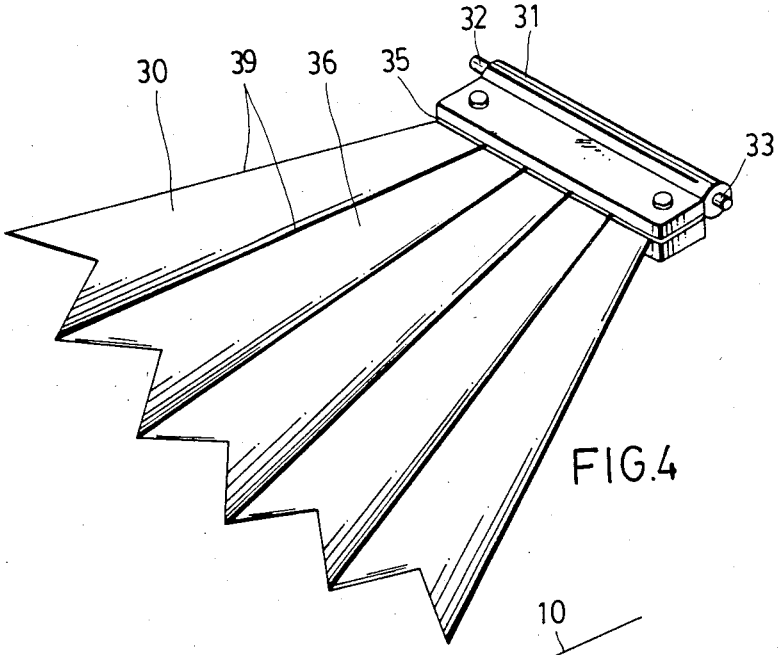
FIG. 4 is a perspective view of the web of the beach-shoe according to this invention.
Figure 5:
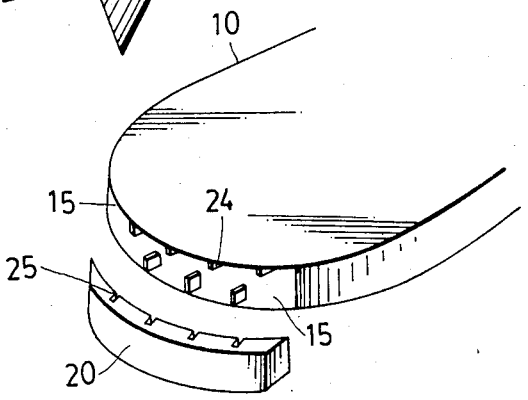
FIG. 5 is an illustration of the engagement of the projections of the platform with the slits formed on the guard piece.

FIGS. 2 and 3 are section views of the shoes, and it can be seen in FIG. 2 that a recess 16 is formed in the bottom of the platform 10, there are two guiding grooves 17 and 18 formed on the opposite side walls of each side of the recess 16 for receiving the spring-loaded pins 32 and 33 which protrude from two ends of a tubular member 31 of the web 30, the spring-loaded pins 32 and 33 are biased toward the guiding grooves 17 and 18 by the springs mounted therein and are slidable along the grooves 17 and 18 both forwards and backwards when a push or pull is given thereto. With respect to the mounting of the web 30 to the platform shoe, first, the web 30 should be inserted through the first cut-out 15 and pushed into the recess 16 with the sliding of the spring-loaded pins 32 and 33 along the grooves 17 and 18 until it is entirely received in the recess 16. Next, the guard piece 20 should be removed from the rear end of the platform 1 and fitted in the first cut-out 15 to restrict the web 30 in an enclosed space, thus a beach-shoe is provided.

A metal plate 35 is welded to the rear end of the web 30, the metal plate 35 is wedged between a pair of packing pieces 37 and 38, so that the stability of the web 30 when sliding in the recess 16 can be increased.

When a diving flipper is needed, the guard piece member 20 should be removed from the first cut-out 15 and fitted in the second cut-out 21 formed on the rear end of the platform 1, the web 30 is slightly protruded outwards from the first cut-out 15 under the biasing of a spring 19 which is mounted in the heel, and by pulling the web 30 outwardly, the spring-loaded pins 32 and 33 may slide along the grooves 17 and 18, so that when moved to the position aligned with the bores 22 and 23, the pins 32 and 33 will extend into the bores 22 and 23 due to the elasticity given by the respective spring thereof, thus a diving flipper is created.

The provision of the packing pieces 37 and 38 enables the web 30 to be held in the recess 16 more firmly and prevent it from wobbling.

It is seen in the drawings that a tubular member 31 is welded to the free side of the metal plate 35, two ends of the tubular member 31 are mounted with spring-loaded pins 32 and 33 respectively, the spring-loaded pins 32 and 33 can be pressed into the tubular member 31. On the other side there are several elastic threads 39 extended therefrom, a plastic membrane 36 is formed by injection molding to extend over the surface including the elastic threads 39. The web 30 can be contracted in longitudinal direction to fit the width of the first cut-out 15 and forms a corrugated configuration with several notches formed on the front end thereof, which corrugated configuration makes it move into and out of the recess 16 without impediment caused by the projections 24. The guard piece 20 is provided with slits 25 to tightly engage with the projections 24 when fitted into the first cut-out 15. And, a sole 40 is secured on the bottom of the platform 1 after the web 30 has been mounted in position.

It can be understood from the above description that this invention provides a shoe with both the functions of beach-shoe and a diving flipper in a simple structure, and eliminates the problems encountered hitherto.

I claim:

1. An adjustable beach-shoe, comprising:

a platform with four straps adjustable in length secured thereon, including a peripheral wall projecting downwards with a recess defined thereby, having a front end and a rear end provided with a first cut-out and a second cut-out with similar shapes respectively, and two sides of said peripheral wall being provided with inward guiding grooves, a spring member mounted in said recess at the end thereof near the rear end of the platform, the spring member providing a biasing force in a direction toward said front end, and a plurality of projections provided with respect to said front end;

a web member including a tubular portion having two ends, a pair of spring-loaded pins mounted on said two ends respectively, a metal plate secured longitudinally to the tubular portion and having an upper surface and a lower surface, a pair of packing pieces attached to said upper surface and said lower surface of said metal plate respectively, a plurality of elastic threads secured to said tubular portion and extended in a direction opposite to said metal plate, a plastic membrane extended over a surface including said elastic threads, said web member being movable forwards and backwards within said recess with the sliding of said spring-loaded pins along said inside guiding grooves when said web member is mounted in said recess;

a sole member mounted on said platform to cover said recess; and a guard piece contoured complementarily with each of said first and second cut-outs and provided with slits for engaging with said projections of said platform, the guard piece for the first cut-out being adapted to fit in said first cut-out when said web member is entirely received in said recess to provide a beach-shoe.

2. An adjustable beach-shoe as claimed in claim 1, wherein a spring member is provided in said recess at the end thereof near the rear end of the platform, the spring member biasing said web member when received therein, so that when said guard piece is removed from first cut-out, said web member is biased to slightly protrude outwardly from said first cut-out, wherein there is further provided a pair of bores respectively formed on said two sides of said peripheral wall near said front end for receiving said spring-loaded pins when said web member is pulled out of said recess by a predetermined distance where said spring-loaded pins are aligned with said bores, with the cooperation of said pair of packing pieces, said metal plate of said web member being held firmly in said front end of said platform.

* * * * *